US006681554B2

(12) United States Patent
Giesen

(10) Patent No.: US 6,681,554 B2
(45) Date of Patent: Jan. 27, 2004

(54) YARN WETTING APPARATUS PARTICULARLY SUITABLE FOR A TWO-FOR-ONE TWISTING SPINDLE AS WELL AS TWO-FOR-ONE TWISTING SPINDLE HAVING SUCH A YARN WETTING APPARATUS

(75) Inventor: Horst Giesen, Mosso-Biella (IT)

(73) Assignee: Volkman GmbH (DE)

( * ) Notice: Subject to any disclaimer, the term of this patent is extended or adjusted under 35 U.S.C. 154(b) by 111 days.

(21) Appl. No.: 09/992,741

(22) Filed: Nov. 16, 2001

(65) Prior Publication Data

US 2003/0093985 A1 May 22, 2003

(30) Foreign Application Priority Data

Nov. 25, 2000 (DE) ..... 100 58 722

(51) Int. Cl.[7] ..... D01H 1/10; D01H 7/86
(52) U.S. Cl. ..... 57/58.49; 57/58.52; 57/296
(58) Field of Search ..... 57/58.49–58.86, 57/295, 296, 297, 298; 118/234, 264, 268, DIG. 18–DIG. 22; 28/178, 57

(56) References Cited

U.S. PATENT DOCUMENTS 3,864,901 A 2/1975 Beymes et al.
4,573,314 A 3/1986 Lorenz
4,759,175 A * 7/1988 Inoue ..... 57/296
5,111,650 A * 5/1992 Lossa et al. ..... 57/296
5,136,836 A * 8/1992 Lossa et al. ..... 57/296

FOREIGN PATENT DOCUMENTS

DE 2317053 B * 7/1974 ..... D01H/7/86
DE 3608436 5/1987

* cited by examiner

*Primary Examiner*—John J. Calvert
*Assistant Examiner*—Shaun R Hurley
(74) *Attorney, Agent, or Firm*—R W Becker & Associates; R W Becker

(57) ABSTRACT

A yarn wetting apparatus, especially for a two-for-one twisting spindle assembly, and a two-for-one twisting spindle assembly having a yarn wetting apparatus disposed on the upper end of its spindle hollow axis, are provided. The yarn wetting apparatus comprises a reservoir, a porous wetting body which extends to the reservoir and has a capillary capacity, and a yarn passage opening which tapers in the direction of the spindle hollow axis of the two-for-one twisting spindle assembly, wherein the inner end of the yarn passage opening is in communication with the reservoir via at least one wetting agent back flow channel.

10 Claims, 1 Drawing Sheet

YARN WETTING APPARATUS PARTICULARLY SUITABLE FOR A TWO-FOR-ONE TWISTING SPINDLE AS WELL AS TWO-FOR-ONE TWISTING SPINDLE HAVING SUCH A YARN WETTING APPARATUS

BACKGROUND OF THE INVENTION

The present invention relates to a yarn wetting apparatus, especially suitable for a two-for-one twisting spindle assembly, as well as a two-for-one twisting spindle assembly having such a yarn wetting apparatus disposed on an upper end of the hollow spindle axis thereof. A yarn wetting apparatus of this type includes a reservoir and a porous wetting body, which has a capillary capability and extends into the reservoir, and which includes a yarn intake opening which tapers to a relatively smaller diameter in the direction of the spindle hollow axis.

A two-for-one twisting spindle assembly or, respectively, a yarn wetting apparatus for a two-for-one twisting spindle assembly of this type, is described in DE 23 17 053 (equivalent to U.S. Pat. No. 3,864,901) and in DE 34 09 233 C1 (equivalent to U.S. Pat. No. 4,573,314).

An important component of a yarn wetting apparatus of this type is a porous wetting body, preferably comprised of a sinter material, which is partially immersed in the reservoir and which absorbs a wetting or lubricating agent directly from the reservoir and/or receives the wetting or lubricating agent supplementally via a wick system. In the operation of the two-for-one twisting spindle assembly, the yarn travels over the wetting body, preferably along a spherically shaped, inwardly tapering yarn passage opening and receives thereby the lubricating or wetting agent which has been delivered as a result of the capillary and suction action of the yarn wetting apparatus acting to draw the wetting agent from the reservoir to the surface of the wetting body over which the yarn travels in a manner such that a thin film of wetting agent or, respectively, a lubricating agent, is formed on the surface. If the yarn removes this film, the equilibrium in the wetting body capillary system is changed and new wetting agent or, respectively, lubricating agent, is transported to the surface. This process operates continuously.

Under certain operating conditions, it can occur that more wetting material is conducted to the wetting body surface over which the yarn travels than is taken up or received by the yarn. In this event, the danger arises that the excess or superfluous wetting agent can drip into the spindle hollow axis onto, for example, the yarn brakes which are disposed therein, which can thus lead to a disturbance of the operation.

As disclosed in DE 36 08 436 A1, in connection with a two-for-one twisting spindle assembly, the yarn wetting apparatus includes a two-portion porous wetting body. One portion comprises several wicks dipped into the reservoir and comprised of felt or another liquid absorbent material and which are disposed in the second wetting body portion which is itself comprised of a porous and firm polyolefin core and comprises a yarn passage opening which tapers inwardly in the yarn travel direction. The lower end of the yarn passage opening communicates into a substantially conical opening formed in a covering cap, which itself communicates with the yarn intake conduit of the two-for-one twisting spindle assembly such that this yarn wetting apparatus also operates to conduct without hindrance superfluous wetting agent into the yarn intake conduit and thereby into the thereto connected spindle hollow axis.

SUMMARY OF THE INVENTION

The present invention offers a solution to the challenge of providing a corresponding yarn wetting apparatus or a two-for-one twisting spindle assembly having a yarn wetting apparatus, respectively, which is so configured that the introduction of superfluous wetting agent into the region of the spindle hollow axis of the two-for-one twisting spindle assembly is prevented.

To provide a solution to this challenge, the inventive two-for-one twisting spindle assembly or, respectively, a corresponding yarn wetting apparatus regarded by itself, is characterized primarily in that the inner end of the yarn passage opening is in connection with the reservoir via at least one back flow channel for back flow therealong of a wetting agent to the reservoir.

In this manner, the superfluous wetting agent, which has not been taken up by the yarn, does not accumulate above the spindle hollow axis but, rather, is returned again directly to the reservoir.

The inner end of the yarn passage opening preferably has a greater diameter than that of the yarn intake opening of a yarn intake conduit which extends along an extension of the spindle hollow axis, the upper end of which is encircled by a receipt chamber for superfluous wetting agent, whereby the receipt chamber is in communication, via one or several back flow channels, with the reservoir.

In connection with the system described in DE 34 09 239 C1, with particular emphasis on FIG. 2 thereof, in which the yarn wetting apparatus comprises a nipple extending through the reservoir and communicated with the spindle hollow axis and on which a portion of the wetting body projecting into the reservoir has been inserted, there is, in a further modification of the apparatus of the present invention, a back flow channel between the outer wall of the nipple and the inner wall of the wetting body portion which projects into the reservoir.

BRIEF DESCRIPTION OF THE DRAWINGS

The object and advantages of the present invention will appear more clearly from the following specification in conjunction with the accompanying schematic drawing, in which:

The sole FIGURE of the drawing shows the preferred embodiment of the yarn wetting apparatus in sectional view on an upper end of the spindle hollow axis of a two-for-one twisting spindle assembly.

DETAILED DESCRIPTION OF THE PREFERRED EMBODIMENT

Figure 1:
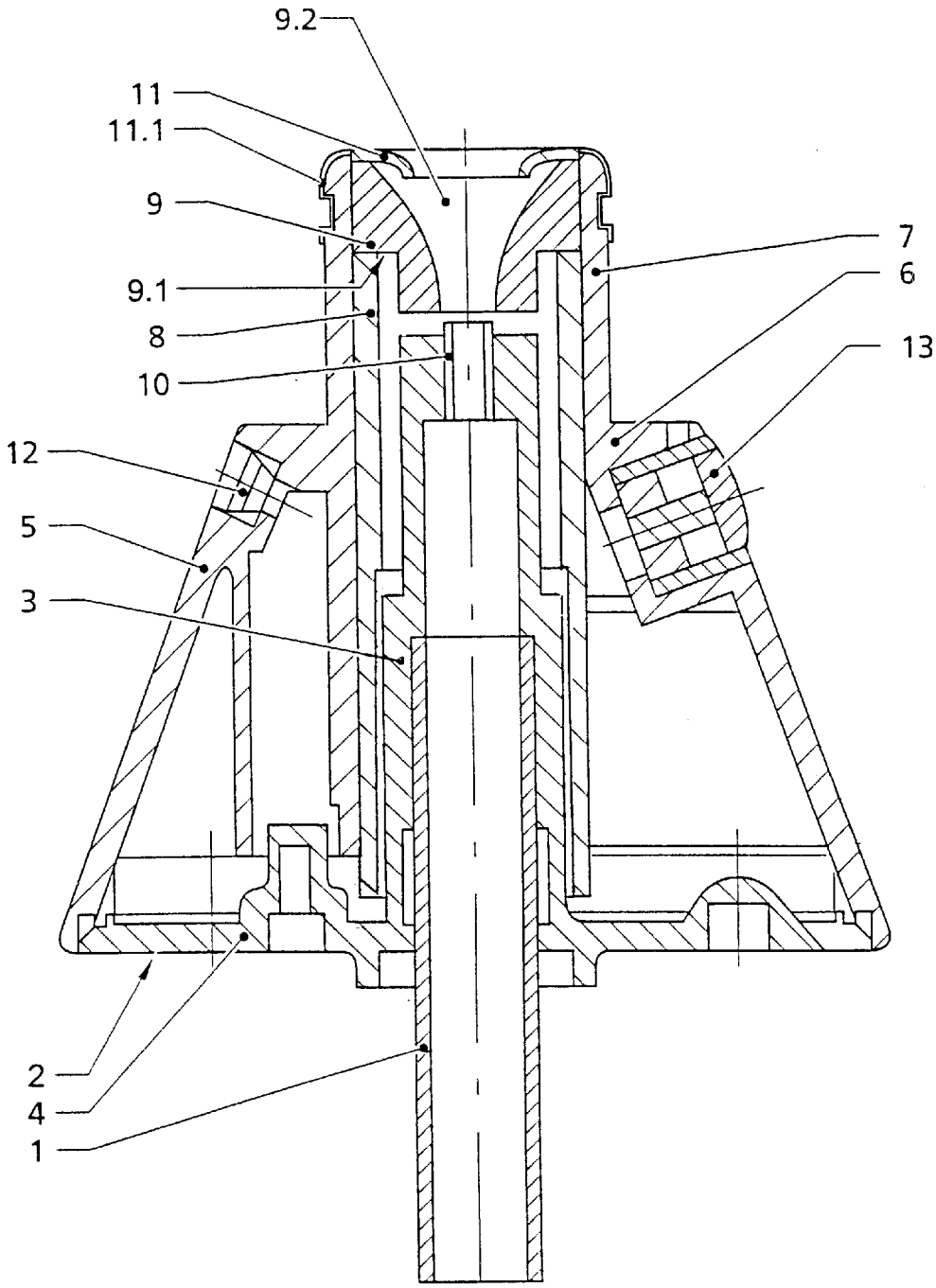

In the sole figure of the drawing, only the upper end of a spindle hollow axis 1, which comprises a portion of a two-for-one twisting spindle assembly, is schematically illustrated. The yarn wetting apparatus 2 comprises, in an arrangement adapted to be suspended onto the spindle hollow axis 1, an inner nipple 3, a reservoir base 4 which is coupled, or respectively formed, with a lower end of the nipple 3, a reservoir wall 5 which is, for example, of a truncated conical shape, and an annular reservoir cover 6 with a nipple 7 mounted thereon or, respectively, formed therewith, and in which a two-portion wetting body 8, 9 comprised of porous material with capillary capacity is disposed. The wetting body portion 8, which is preferably rotationally symmetrical and extends into the reservoir 4, 5, 6, is comprised of a sinter material having relatively coarse granulation while the upper, rotationally symmetric wetting body portion 9 is comprised of a sinter material having, in contrast, a relatively fine granulation. The upper wetting body portion 9 has a yarn passage opening 9.2 which tapers inwardly in a substantially conical shape in the direction from its top toward its bottom, the yarn passage opening being substantially spherically shaped and supported via a collar 9.1 on the upper end of the nipple 7. The top side of the upper wetting body portion 9 is covered by a dosing plate 11, preferably exchangeable, in order to provide adjustment of the contact surface between the yarn which extends into the yarn passage opening 9.2 and the spherical inner wall of the conically shaped passage opening 9.2. The dosing plate 11 is secured by a clamp ring 11.1 to the upper end of the nipple 7.

The inner end of the yarn passage opening 9.2 has a relatively greater diameter than that of the yarn intake opening of a yarn intake conduit 10 which extends along an extension of the spindle hollow axis 1, the yarn intake conduit 10 comprising either a portion of the spindle hollow axis 1 itself or being suspended onto the upper end of a closed nipple 3. The upper end of the yarn intake conduit 10 lies above the top side of the nipple 3 and substantially forms thereby a weir which is encircled by a receipt chamber for receiving a wetting agent, the receipt chamber itself opening into an annular gap between the nipple 3 and the lower wetting body portion 8. The annular gap forms thereby a back flow channel through which superfluous wetting agent can directly flow back to the reservoir.

A fill valve 12, which is not part of the invention, as well as an exhaust and intake valve 13, communicate with the reservoir 4, 5, 6.

In lieu of a back flow channel formed via an annular gap, one or several axially extending grooves can be provided between the outer wall of the nipple 3 and the inner wall of the lower wetting body portion 8—preferably, these can be provided on the inner wall of the wetting body portion 8.

The specification incorporates by reference the disclosure of German priority document 100 58 722.4 of Nov. 25, 2000.

The present invention is, of course, in no way restricted to the specific disclosure of the specification and drawings, but also encompasses any modifications within the scope of the appended claims.

What I claim is:

1. A yarn wetting apparatus particularly suitable for a two-for-one twisting spindle assembly, the two-for-one twisting spindle assembly including a yarn intake conduit, the yarn wetting apparatus comprising:

a reservoir;

a porous wetting body extending to the reservoir and having capillary capacity, the wetting body having a yarn passage opening which tapers inwardly in the direction of yarn travel to an inner end which is spaced above the yarn intake conduit relative to the direction of yarn travel; and at least one wetting agent back flow channel that communicates the inner end of the yarn passage opening with the reservoir.

2. A yarn wetting apparatus according to claim 1, wherein the at least one wetting agent back flow channel includes an annular gap below the inner end of the yarn passage opening of the wetting body through which superfluous wetting agent, after exiting the inner end of the yarn passage opening, flows radially outwardly into the remainder of the wetting agent back flow channel which ultimately communicates with the reservoir.

3. A two-for-one twisting spindle assembly having a spindle hollow axis and a yarn intake conduit comprising:

a yarn wetting apparatus disposed at the upper end of the spindle hollow axis, the yarn wetting apparatus having a reservoir and a porous wetting body which extends into the reservoir and has capillary capacity, the wetting body having a yarn passage opening which tapers inwardly in the direction of the yarn intake conduit and in the direction of the spindle hollow axis to an inner end which is spaced above the yarn intake conduit relative to the direction of yarn travel; and at least one wetting agent back flow channel that communicates the inner end of the yarn passage opening with the reservoir.

4. A two-for-one twisting spindle assembly according to claim 3, wherein the inner end of the yarn passage opening has a relatively greater diameter than that of the yarn intake opening of a yarn intake conduit which extends along an extension of the spindle hollow axis, the upper end of the yarn intake conduit being encircled by a receipt chamber for receiving superfluous wetting agent, and the receipt chamber is in communication with the reservoir through one or more back flow channels.

5. A two-for-one twisting spindle assembly according to claim 3, wherein the yarn wetting apparatus is mounted above the reservoir and includes a nipple on which the downwardly extending portion of the wetting body is supported and each back flow channel extends between the outer wall of the nipple and the inner wall of the wetting body portion.

6. A two-for-one twisting spindle assembly according to claim 5, wherein an annular gap is provided as a back flow channel between the outer wall of the nipple and the inner wall of the wetting body.

7. A two-for-one twisting spindle assembly according to claim 5, wherein at least one axially extending groove extends between the outer wall of the nipple and the inner wall of the wetting body.

8. A two-for-one twisting spindle assembly according to claim 7, wherein each groove is disposed on the inner wall of the wetting body.

9. A two-for-one twisting spindle assembly according to claim 3, wherein the wetting body is comprised of two portions, a lower portion of which comprises a sinter material of relatively coarse granulation and an upper portion of which comprises a sinter material with a contrastingly finer granulation.

10. A two-for-one twisting spindle assembly according to claim 3, wherein the at least one wetting agent back flow channel includes an annular gap below the inner end of the yarn passage opening of the wetting body through which superfluous wetting agent, after exiting the inner end of the yarn passage opening, flows radially outwardly into the remainder of the wetting agent back flow channel which ultimately communicates with the reservoir.

* * * * *